US011105055B1

(12) United States Patent
Maguire

(10) Patent No.: US 11,105,055 B1
(45) Date of Patent: Aug. 31, 2021

(54) APPARATUS AND SYSTEM FOR LIMITING TRANSVERSE MOVEMENT ALONG AN OVERHANGING LEDGE

(71) Applicant: Michael Maguire, Fresno, CA (US)

(72) Inventor: Michael Maguire, Fresno, CA (US)

( * ) Notice: Subject to any disclaimer, the term of this patent is extended or adjusted under 35 U.S.C. 154(b) by 276 days.

(21) Appl. No.: 16/268,415

(22) Filed: Feb. 5, 2019

(51) Int. Cl.
*E01F 13/02* (2006.01)
*E04H 17/16* (2006.01)

(52) U.S. Cl.
CPC ..... *E01F 13/022* (2013.01); *E04H 17/16* (2013.01)

(58) Field of Classification Search
CPC ..... E01F 13/022; E01F 13/02; E04H 17/16
See application file for complete search history.

(56) References Cited

U.S. PATENT DOCUMENTS 122,067 A * 12/1871 Seat ..... E04H 17/16 256/31
151,504 A * 6/1874 Murphy ..... E04H 17/16 256/31
196,667 A * 10/1877 Hotham ..... E04H 17/16 256/31
5,779,227 A * 7/1998 Elkins ..... E04H 17/18 256/24
7,494,112 B2 * 2/2009 Fromm ..... E01F 13/12 256/64
8,308,141 B1 * 11/2012 Mellins ..... E04H 17/163 256/25
2008/0006809 A1 * 1/2008 Stoffels ..... E04G 21/3223 256/67
2010/0295007 A1 * 11/2010 Preston ..... E04G 21/3233 256/31
2012/0186909 A1 * 7/2012 Chilton ..... E04H 17/1417 182/113
2014/0208643 A1 * 7/2014 Inglis ..... A01G 13/105 47/33
2014/0334875 A1 * 11/2014 Hoffman ..... E01F 15/083 404/6
2019/0345732 A1 * 11/2019 Wicks ..... E04H 17/06
2021/0002834 A1 * 1/2021 Putnam ..... E01F 13/02

* cited by examiner

*Primary Examiner* — Abigail A Risic
(74) *Attorney, Agent, or Firm* — Richard A. Ryan

(57) ABSTRACT

An apparatus for use with a barrier having an overhanging ledge to limit movement by a person on the ledge. The apparatus has an upright member that is positioned next to the barrier, a base member at a lower end of the upright member that is positioned on a surface adjacent the barrier and opposite the ledge, a mechanism for engaging the barrier to hold the apparatus in place and a plurality of limiting members that extend across the ledge to prevent movement past the apparatus. In one configuration, each of the limiting members extend through openings in a railing above the barrier. The engaging mechanism defines a gap that receives the barrier to hold the apparatus to the barrier. The base member can have a footplate on which weight can be placed. A system has a pair of apparatuses that define an area in which movement is allowed.

20 Claims, 6 Drawing Sheets

APPARATUS AND SYSTEM FOR LIMITING TRANSVERSE MOVEMENT ALONG AN OVERHANGING LEDGE

BACKGROUND OF THE INVENTION

A. Field of the Invention

The present invention relates generally to apparatuses and systems that are useful for limiting the movement of persons or animals along a surface. In particular, the present invention relates to such apparatuses and systems that are specially adapted to prevent transverse movement along an overhanging ledge that is defined by a fence, wall or other barrier. Even more particularly, the present invention relates to such apparatuses and systems that are utilized to limit the transverse movement of a person who is threatening to jump off of a ledge of an elevated surface onto a lower surface, such as a barrier on a highway overpass bridge onto a highway, freeway or other roadway surface below.

B. Background

People frequently travel by motor vehicles, including cars, trucks, motorcycles, RVs and the like, along highways, freeways and other roadways that allow the person operating the motor vehicle to travel at relatively high speeds with few if any intentional restrictions to the movement of vehicles on the roadway. As well known, along the length of the roadway there will be locations where streets, walkways, train tracks or other roadways will intersect with the primary roadway. For purposes of describing the invention set forth herein, these streets, walkways, train tracks, roadways and the like are collectively referred to as intersecting passageways. To accomplish the objective of attempting to provide uninterrupted motor vehicle travel along the primary roadway and to avoid interference with the safe use of the intersecting passageway, the roadway will either pass under or over the intersecting passageway. An overpass bridge is provided at the locations where the roadway passes under an intersecting passageway to allow persons, whether they are in a motor vehicle or not, to safely pass over the roadway without interfering with the movement of motor vehicles on the roadway.

As well known, most overpass bridges are sufficiently high above the roadway below that any vehicle or person falling from the overpass bridge onto the roadway is likely to severely injure or even kill the occupant(s) of the vehicle or the person, and to result in injury or death to occupant(s) of a motor vehicle moving on the roadway below. To prevent motor vehicles and people from driving or falling off an overpass bridge onto a roadway, the typical overpass bridge has a concrete, block, metal or other strong barrier along the opposing sides of the intersecting passageway as it passes over roadway and a railing or the like extending upward from the top surface of the barrier. The barriers at the sides of the intersecting passageway is designed to be sufficiently strong enough to prevent motor vehicles moving across the overpass bridge from driving off the sides thereof and onto the roadway below. The railing extending upward from the top of the vehicle barrier is designed to keep pedestrians, bicyclists and the like, as well as to a certain extent motor vehicles, from falling off the sides of the bridge onto the roadway below. In one configuration, the railing is a chain link fence or the like having a plurality of openings through the sides thereof. In some configurations, the overpass bridge will only have the barrier (i.e., without the railing) at the sides of the intersecting passageway. The typical design for the barrier/railing combinations that are commonly utilized over a roadway results in a small ledge or ledge-like surface located next to the railing along the entire length of the overpass bridge on the side of the railing that is outside of the passageway and above the roadway. Likewise, the overpass bridges that only have a barrier also tend to have a small ledge on the side of the barrier over the roadway. These small ledges, which may be only six inches or so wide and which overhang the roadway, are not intended for use by people in any manner at all.

Unfortunately, some people who desire to harm themselves will climb over or otherwise go around the railing and enter out onto the overhanging ledge of an overpass bridge to jump, or at least threaten to jump, onto the roadway below. Because the height of most overpass bridges above the roadway is likely to result in serious injury or death to the jumper and possible injury or death to occupants in the motor vehicles traveling on the roadway, the police and other authorities take action to stop the traffic on the roadway and to prevent the person from jumping off the overpass bridge. In one approach, the police or other persons will attempt to talk the potential jumper from jumping by getting him or her to leave the ledge and safely reenter the passageway. In case that does not work, the police are usually also taking action that may enable them to grab the person, usually through the railing while on the passageway side of the barrier, to prevent him or her from jumping off the ledge. In addition to the above, the police will stop traffic on the roadway and take action below the overpass bridge to reduce the likelihood of injury or death to the person if he or she does jump. One action that is commonly taken is for the fire department or other agency to place a large, strong inflatable bag, such as the type commonly utilized by stuntmen and women when filming movies, below the potential jumper so that he or she will land on the inflated bag instead of the hard surface of the roadway. Other action that may be taken by persons to stop a jumper, is for someone, often a fireman or woman, to approach the potential jumper from below with lift bucket or the like that allows the rescuer to talk to the potential jumper in an attempt to talk him or her out of jumping or, if deemed safe and necessary, to be able to reach the potential jumper and grab him or her before they can jump.

Whether the rescuers are using the large inflatable bag or trying to reach the potential jumper with a lift bucket, or taking both actions, the only way that these actions can be effective is if the position of the potential jumper is at least somewhat fixed or narrowed. As will be readily appreciated by persons who are skilled in the relevant art, the inflated bag only works if it is placed below where the potential jumper may jump and the lift bucket is only effective if it can be raised to where the potential jumper is located. Because most overpass bridges are somewhat long, the positioning of the inflated bag or the bucket lift can be hard to determine if the potential jumper is allowed to move transversely, meaning in a direction transverse to the surface of the roadway below, along the overhanging ledge of the overpass bridge. To assist the rescuers with attempting to stop a person from jumping from an overpass bridge onto a roadway or to lessen the person's likelihood of injury or death if he or she does jump, it would be beneficial to limit the ability of the potential jumper to move transversely along the length of the overhanging ledge of an overpass bridge.

One current method of limiting the transverse movement of a potential jumper along a ledge of an overpass bridge is to station a policeman, firefighter or other person generally against the barrier/railing or barrier at positions on the overpass bridge that will define the limits of the potential jumper's ability to move along the ledge. A major issue with this method is that it depends on the ability of the rescuer person to stop the potential jumper from moving past his or her position without causing the jumper to fall off of the ledge. An apparatus that is used to limit movement of a potential jumper along a ledge of an overpass bridge has a post with a plurality of perpendicularly disposed, outwardly extending bars, an example of which is shown as FIG. 4 in the drawings included herewith, that is held with the post vertical and the bars extending through the railing and sufficiently over the ledge that the potential jumper cannot move beyond the location of the apparatus. One apparatus is held in place against the railing by a person located at each of the ends of the allowed movement area. A problem with this apparatus is that the rescuer must continuously hold the apparatus in place as long as the potential jumper is on the ledge. Because they are intended to be strong, they are generally made out of metal that is somewhat heavy, which results in the apparatus being somewhat difficult and quite tiresome to hold up at the barrier/railing. Another problem is that these apparatuses do not work particularly well with barriers that do not have a railing for the rescuer to lean or push against. Another problem is that the potential jumper may be able to push against the apparatus to cause the person holding the apparatus to lose his or her footing and move back from the barrier/railing, which can allow the potential jumper to move beyond what was the intended limit of his or her allowed movement area.

What is needed, therefore, is an improved apparatus for limiting the ability of a person who is on an overhanging ledge of an elevated structure, such as an overpass bridge above a roadway, to move transversely along the ledge. More specifically, what is needed is an apparatus that is configured to be utilized to limit the transverse movement of a person who is on a ledge of an overpass bridge or other elevated structure and threatening to jump onto the roadway, or other lower surface, below so the police, firefighter and other rescuers can beneficially place an inflatable bag and/or reach the potential jumper with a bucket lift. An improved apparatus should be configured to be quickly and securely positioned on or against a barrier and, if applicable, extend through the railing to place components thereof over the ledge to prevent a potential jumper from moving beyond the location of the apparatus, thereby limiting his or her movement along the ledge to only the area between a pair of spaced apart apparatuses. The improved apparatus should be easy to hold in place and effective at preventing movement past the positioned apparatus. Preferably, the new apparatus should be adaptable for use with a wide variety of different types of barrier/railing combinations and barriers that do not use railings. In a preferred configuration, the new apparatus should be relatively inexpensive to manufacture so that it can be widely utilized.

SUMMARY OF THE INVENTION

The new apparatus and system of the present invention provides the benefits and solves the problems that are identified above. That is to say, the apparatus and system of the present invention can be beneficially utilized to limit the transverse movement of a person along a ledge associated with an elevated structure over a lower surface, such as overpass bridge above a roadway. The apparatus of the present invention is structured and arranged to limit the ability of a person who is on an overhanging ledge, and who is threatening to jump therefrom, to move transversely along the ledge. More specifically, the apparatus of the present invention is structured and arranged to safely and effectively limit the transverse movement of a person who is on the ledge of an elevated structure, such as an overpass bridge, and threatening to jump onto a surface, such as a roadway, below so the police, firefighter and other rescuers can place an inflatable bag under the potential jumper and/or reach the potential jumper with a bucket lift. In one embodiment, the improved apparatus is configured to be quickly and securely positioned on or against a barrier and, if applicable, extend through the railing located above the barrier to place the limiting components of the apparatus over a ledge associated with the barrier in a manner which prevents a potential jumper from moving beyond the location of the apparatus. In another embodiment, useful for barriers not having railing, the apparatus is configured to be placed over the top surface of the barrier quickly and securely position the limiting components over the overhanging ledge of the barrier. When a pair of the new apparatuses are placed in spaced apart relation on at a ledge of an elevated structure, the two apparatuses will limit the movement of a potential jumper along the ledge to only the area between the pair of apparatuses. The apparatus of the present invention is specially configured to be easy to keep in position at the barrier and effective at preventing the potential jumper from moving past the apparatus. The movement limiting apparatus can be made out of a wide variety of materials, including those which may be relatively lightweight so the apparatus will be easy to handle. The new movement limiting apparatus of the present invention is readily adaptable for use with a wide variety of different configurations of barrier/railing combinations and barriers without a railing. In the preferred configurations, the apparatus is relatively inexpensive to manufacture, which will allow the new apparatus to be widely utilized and available.

In one embodiment of the present invention, the improved movement limiting apparatus for limiting movement along a ledge associated with a barrier generally comprises an upright member, a base member that is attached to or integral with a lower end of the upright member and a plurality of outwardly extending limiting members that are connected to the upright member so as to be supported thereby. The upright member is sized and configured to be position at an inward side of the barrier when the apparatus is utilized with the barrier to prevent movement along the ledge associated therewith. The base member is configured to be positioned at a passageway surface of a passageway, such as a road or the like across a bridge, adjacent the barrier when the apparatus is utilized with the barrier. The limiting members extend across the ledge and into the overhang area above a freeway or other lower surface, to prevent movement on the ledge past the apparatus when the upright member is at the inward side of the barrier. In one configuration, an upper end of the barrier defines an upper surface thereof, there is a railing above the upper surface, the ledge is defined by the upper surface of the barrier between the railing and an outward side of the barrier and each limiting member is sized and configured to extend through openings in the railing so as to define a limiting position with the apparatus. Typically, in this configuration the upper end of the upright member extends above an upper end of the railing and each of the limiting members are disposed between a lower end and the upper end of the railing.

To help secure the apparatus in place, the apparatus is provided with a footplate that is attached to or integral with the base member, with the footplate having a plate surface on which weight, such as a person's body weight or sand bags, may be placed to secure the base member to the passageway surface and the upright member at the inward side of the barrier. To further help secure the apparatus in place, the apparatus can have a barrier engaging mechanism that is attached to or integral with the upright member and/or the base member, with the barrier engaging mechanism being structured and arranged to engage the barrier to securely position the upright member at the inward side of the barrier when the apparatus is utilized with the barrier. In one configuration, the barrier engaging mechanism comprises an L-shaped engaging member that has a horizontally disposed first member which is attached to or integral with the upright member and a downwardly disposed second member that is attached to or integral with the first member. The first member and second member are structured and arranged to define a barrier gap between the second member and the upright member, with the barrier gap being sized and configured to receive the barrier therein when the apparatus is utilized to define a limiting position that prevents transverse movement on the ledge past the apparatus. In another embodiment, the barrier engaging mechanism comprises a crossing member and an outward member extending downward from the crossing member. The crossing member is attached to or integral with the upright member so as to extend across an upper end of the barrier. The outward member is in spaced apart relation to the upright member so as to define a barrier gap therebetween that is sized and configured to receive the barrier therein when the apparatus is utilized to define a limiting position to prevent movement on the ledge past the apparatus. In this configuration, each of the limiting members are attached to or integral with the outward member so as to extend outwardly therefrom across the ledge and into the overhang area to prevent a person on the ledge from moving beyond the apparatus.

A movement limiting system comprises a road or other passageway having a passageway surface, an overhang area located above a freeway or other lower surface, a barrier separating the passageway and the overhang area, a ledge associated with the barrier such that the ledge is located in or toward the overhang area so as to be positioned in spaced apart relation above the lower surface, a first movement limiting apparatus and a second movement limiting apparatus in spaced apart relation to the first movement limiting apparatus to define an allowed movement area therebetween. Each of the first apparatus and second apparatus are configured as described above to prevent movement on the ledge outside of the allowed movement area when the first apparatus and the second apparatus are utilized with the barrier to prevent movement along the ledge.

Accordingly, the primary object of the present invention is to provide a new apparatus and system for limiting transverse movement along an overhanging ledge of an elevated structure, such as an overpass bridge or the like, that has the advantages set forth above and which overcomes the known disadvantages and limitations which are associated with presently available methods, apparatuses and systems for limiting such movement.

It is an important object of the present invention to provide a new movement limiting apparatus that is specially structured and arranged to prevent a person from moving transversely along an overhanging ledge associated with a barrier or barrier/railing combination in order to allow other persons to discourage the person from jumping off an elevated structure or from being severely hurt or killed if he or she does jump.

It is also an important object of the present invention to provide a new movement limiting apparatus that is specially structured and arranged so a person holding the apparatus in place will not easily become tired from having to press the apparatus against the barrier and/or railing and or which cannot be overcome by forceful pushing by the potential jumper.

An important aspect of the present invention is that it provides a new movement limiting apparatus which accomplishes the objectives set forth above and elsewhere in the present disclosure.

Another important aspect of the present invention is that it provides a new movement limiting apparatus which is structured and arranged to quickly, safely and effectively limit the transverse movement of a person who is positioned on an overhanging ledge that is associated with a barrier of an elevated structure, such as an overpass bridge which crosses above a roadway.

Another important aspect of the present invention is that it provides a new movement limiting apparatus which, in one embodiment, is structured and arranged to be positioned on or against a barrier of an overpass bridge or other elevated structure and extend through the railing located above the barrier to place the limiting components of the apparatus over a ledge associated with the barrier in a manner which prevents a potential jumper from moving beyond the location of the apparatus.

Another important aspect of the present invention is that it provides a new movement limiting apparatus which is specially configured to be easy for the users thereof to place and keep the apparatus in the desired position at the barrier so as to be effective at preventing a potential jumper who is on an overhanging ledge associated with the barrier from moving past the apparatus.

Another important aspect of the present invention is that it provides a new movement limiting apparatus and system which is readily adaptable for use with a wide variety of different types, sizes and configurations of barrier/railing combinations and barriers without a railing.

Yet another important aspect of the present invention is that it provides a new movement limiting apparatus and system which, in a preferred configuration, is easy to use and relatively inexpensive to manufacture.

As will be explained in greater detail by reference to the attached figures and the description of the preferred embodiments which follow, the above and other objects and aspects are accomplished or provided by the present invention. As set forth herein and will be readily appreciated by persons who are skilled in the art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. The scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular materials, shapes and configurations for the various components of the apparatus of the present invention, as well as examples of barriers, with or without railing, with which the new apparatus may be utilized, persons who are skilled in the relevant art will readily appreciate that the present invention is not so limited. In addition, the exemplary embodiments of the present invention are shown and described herein with only those components that are required to disclose the present invention. As such, it may be possible that some of the necessary elements for attaching and using the present invention are not shown or necessarily described below, but which are well known to persons who are skilled in the relevant art. As will be readily appreciated by such persons, the various elements of the present invention that are described below may take on any form which is consistent with forms that may be understood by a person of ordinary skill in the art having knowledge of barriers, with or without railing, and the overhanging ledges that are commonly associated with such barriers.

Figure 1:
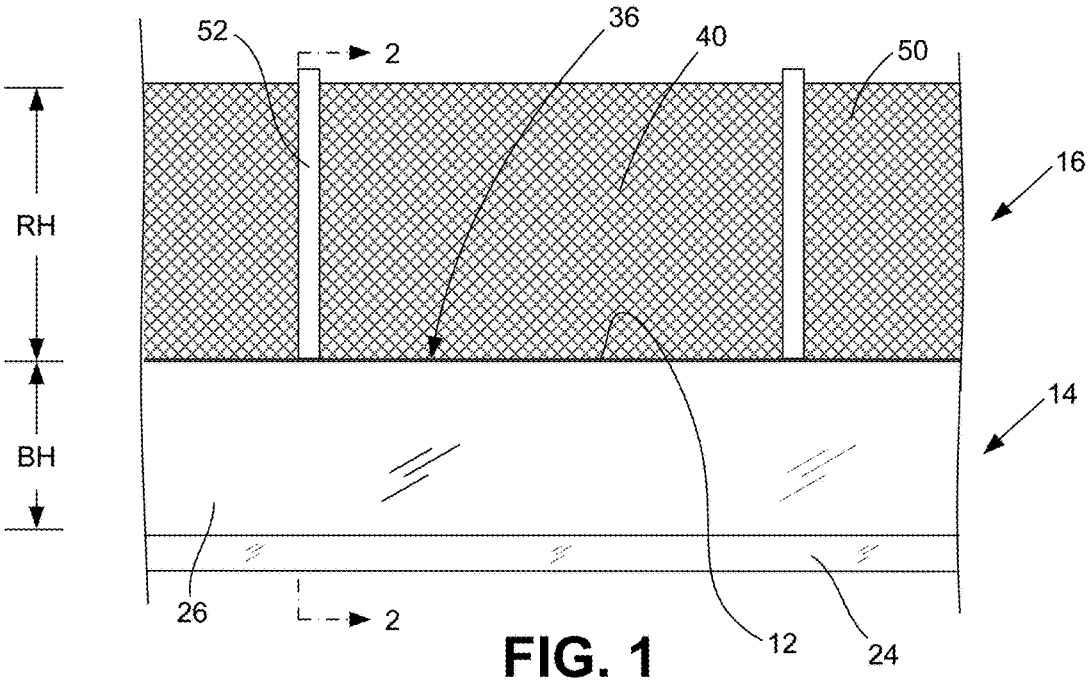
FIG. 1 (PRIOR ART)
FIG. 1 is a side view of a prior art barrier having a railing thereon with the upper surface of the barrier defining an overhanging ledge.
Figure 2:
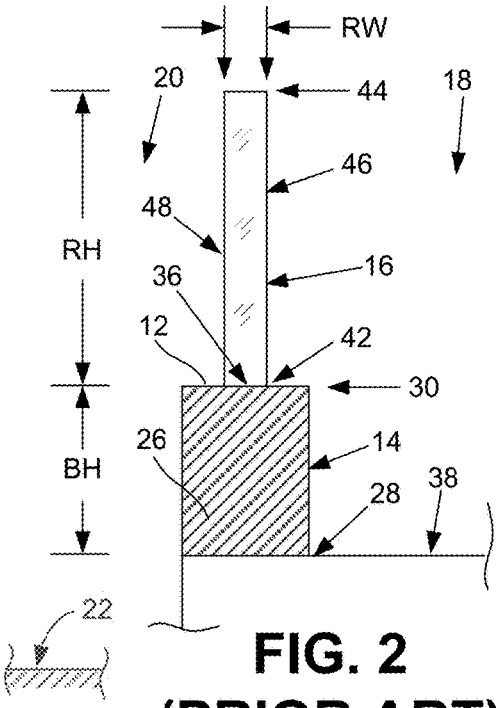
FIG. 2 (PRIOR ART)
FIG. 2 is a cross-sectional end view of the prior art barrier and railing of FIG. 1 taken through line 2-2 of FIG. 1 illustrating the relationship between the barrier and the railing which defines the overhanging edge.
Figure 3:
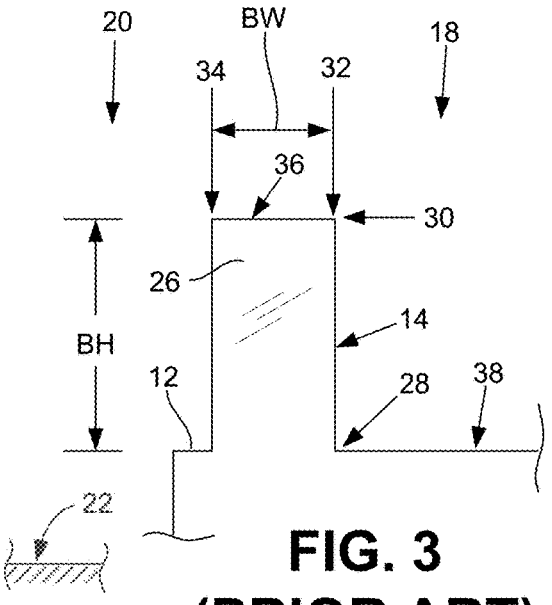
FIG. 3 (PRIOR ART)
FIG. 3 is an end view of a prior art barrier that does not have a railing thereon showing the overhanging edge located below the upper end of the barrier.
Figure 8:
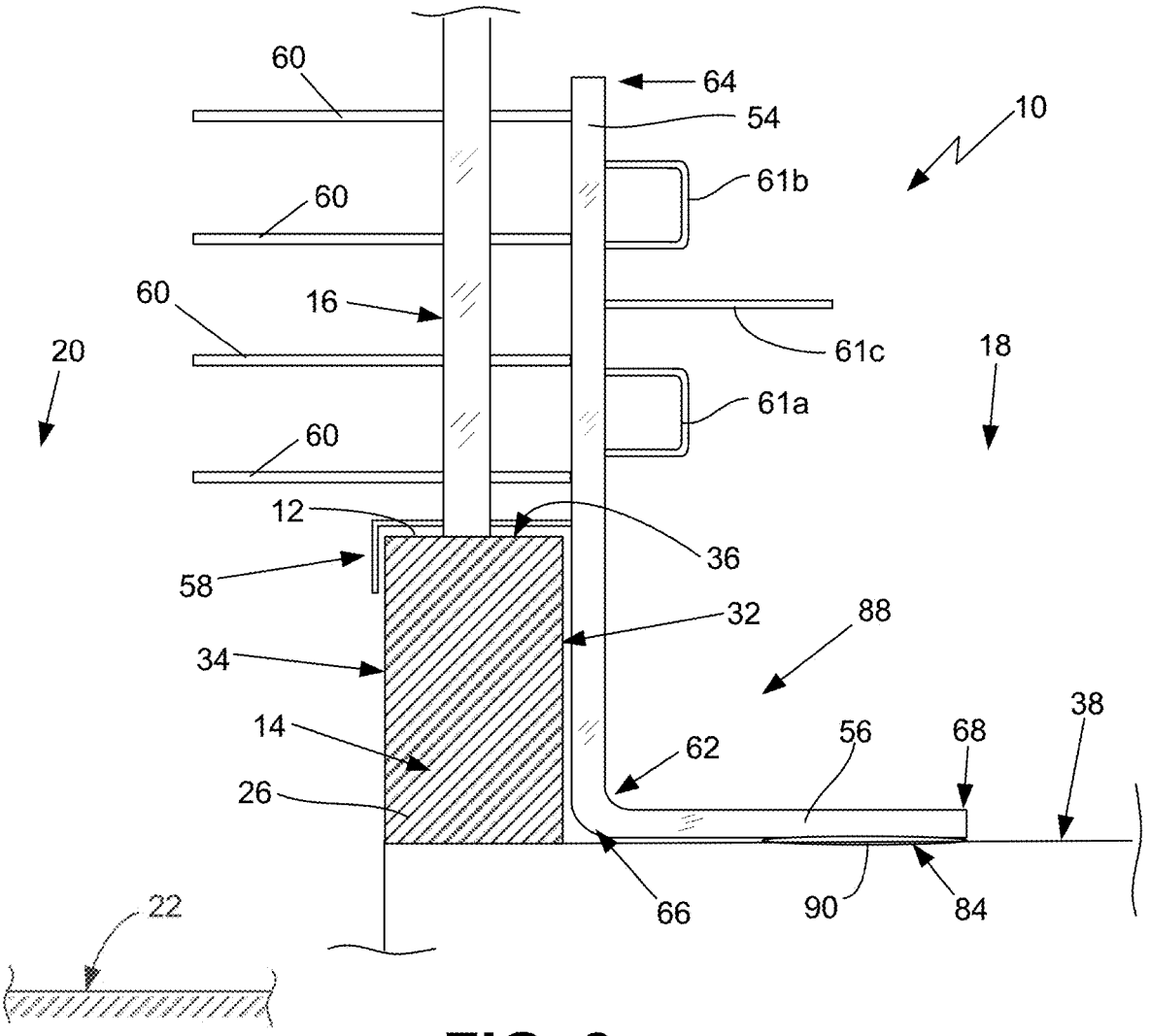
FIG. 8 is a side view of the apparatus of FIG. 5 shown in use with the barrier/railing combination of FIGS. 1 and 2 to limit movement along the overhanging ledge associated with the barrier.
Figure 9:
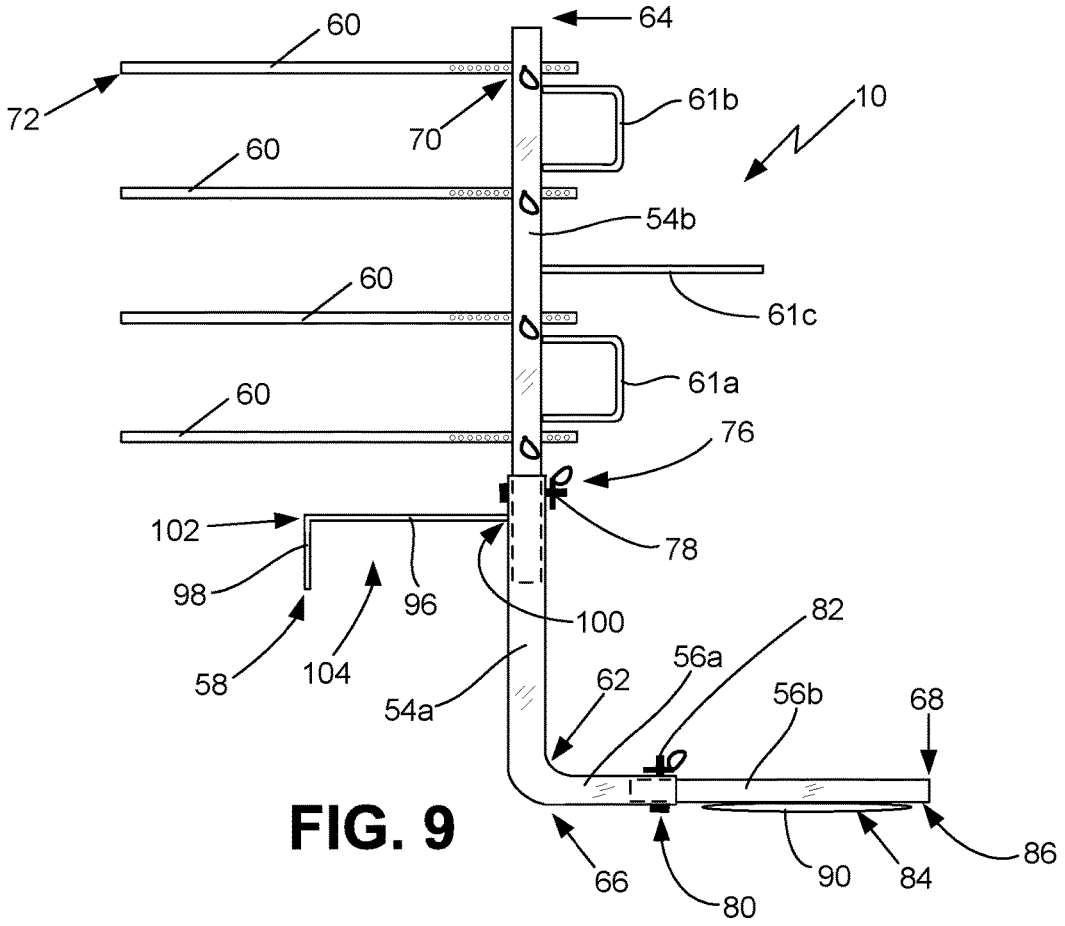
FIG. 9 is a side view of a movement limiting apparatus that is configured according to a second embodiment of the present invention for limiting transverse movement along an overhanging ledge of the barrier/railing combination shown in FIGS. 1 and 2 showing use of a height adjusting mechanism to adjust the position of the limiting members and the use of selective placement of the limiting members on the upright member.
Figure 10:
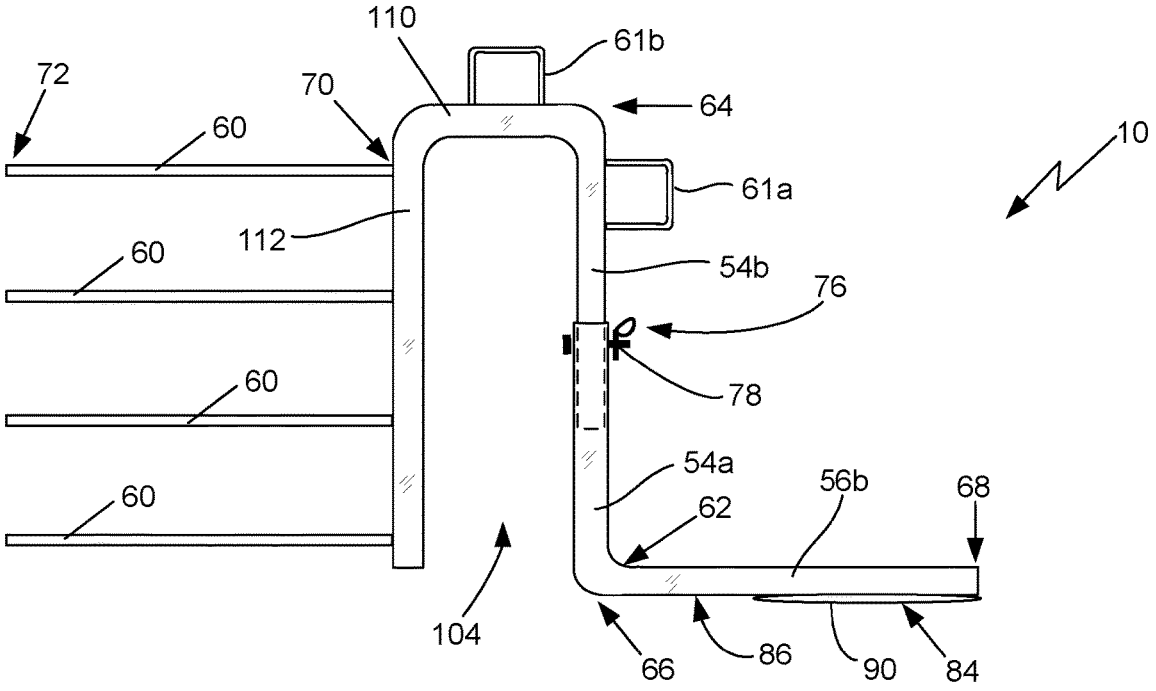
FIG. 10 is a side view of a movement limiting apparatus that is configured according to a third embodiment of the present invention for limiting transverse movement along an overhanging ledge of the barrier shown in FIG. 3.
Figure 11:
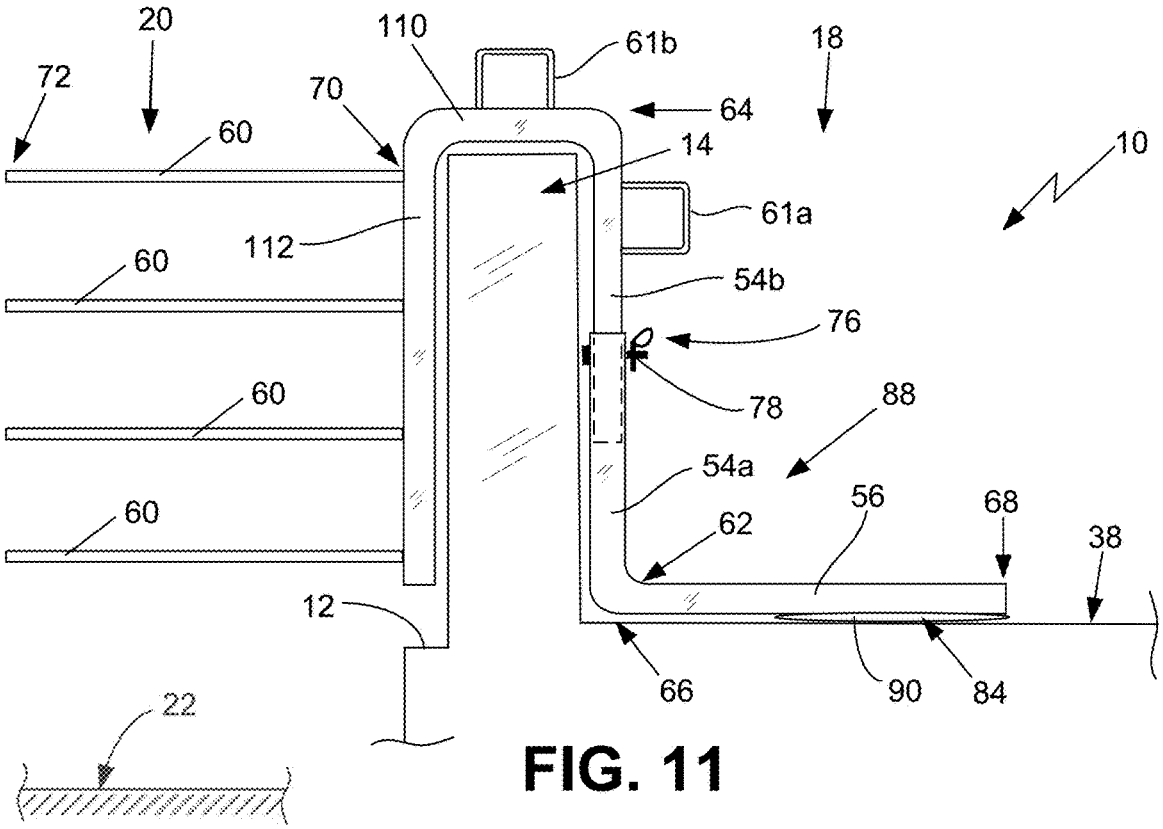
FIG. 11 is a side view of the apparatus of FIG. 10 shown in use with the barrier of FIG. 3 to limit movement along the overhanging ledge associated with the barrier.
Figure 13:
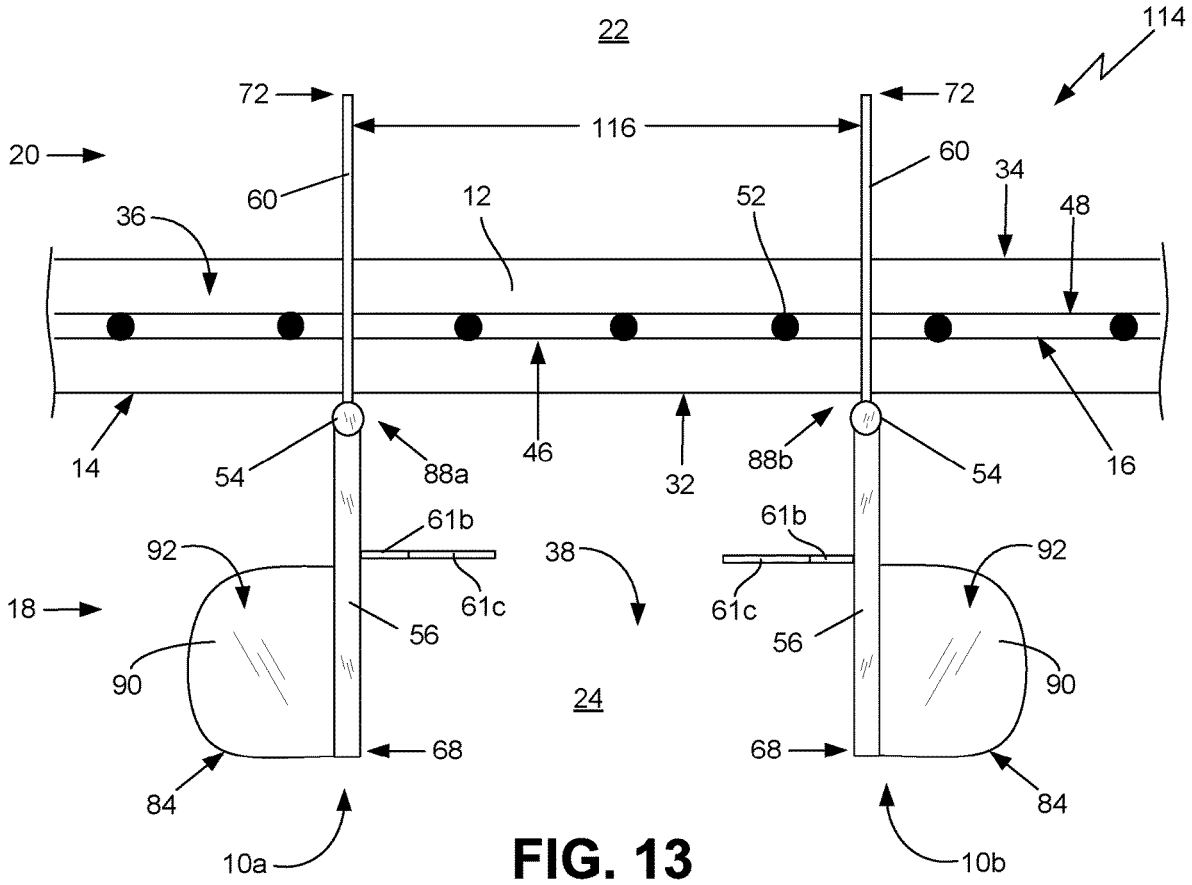
FIG. 13 is a top view of a system showing use of a pair of apparatuses with a barrier to define an allowed movement area therebetween.

A movement limiting apparatus that is configured pursuant to preferred embodiments of the present invention is referred to generally as 10 in FIGS. 5-11. As set forth in more detail below, the new apparatus 10 of the present invention is structured and arranged to be utilized to limit transverse movement of a person on an overhanging ledge 12 associated with a barrier 14, with or without a railing 16 (as shown in FIGS. 1-3), that is utilized to separate an intersecting passageway 18 from an overhang area 20 that located in spaced is above a lower surface 22, as best shown in FIGS. 8, 11 and 13. As set forth above, for purposes of describing the present invention, the intersecting passageway 18 is typically a bridge 24 that supports a street, road, walkway, bicycle path or any other passageway that may utilized by people who are walking, riding bicycles or on a motor vehicle to cross above the lower surface 22. Likewise, the lower surface 22 may be a roadway, such as a freeway, highway or the like, that is utilized by motor vehicles, with the bridge-supported passageway 18 being provided to allow the motor vehicles to move unobstructed, at least with regard to the intersecting passageway 18, along the lower surface 22 (i.e., roadway). In other uses, the lower surface 22 may be a waterway, such as a river, creek, lake, ocean or the like, with the bridge 24 being provided to allow persons to move unobstructively above and across the waterway (i.e., as the lower surface 22). As will be readily appreciated by persons who are skilled in the relevant art, the apparatus 10 of the present invention can be utilized with ledges 12 that are associated with a wide variety of elevated structures.

As set forth in the Summary, the apparatus 10 of the present invention can be utilized for a wide variety of different configurations of barriers 14 that have a ledge 12 associated therewith, typically defined by the barrier 14, in the overhang area 20 in order to limit the transverse movement of a person on the ledge 12. The barriers 14 and railings 16 can be made out of a wide variety of materials, such as metal or the like, or combinations of materials. By limiting the extent the person can transversely move along the ledge 12, the police, firefighters and/or others can have a better opportunity to prevent the person from jumping off the ledge 12 onto the lower surface 22 and/or an improved ability to place one or more items, such as large inflatable bags, on the lower surface 22 to reduce the likelihood the person will be injured or killed if he or she does jump from the ledge 12 toward the lower surface 22. The barrier 14 has a barrier body 26 that defines a lower end 28, an upper end 30, an inward side 32 and an outward side 34 of the barrier 14, as best shown in FIGS. 1-3. As also shown in these figures, the barrier 14 has an upper surface 36 at the upper end 30 thereof and the lower end 28 is positioned adjacent a passageway surface 38 of the passageway 18 to separate the passageway 18 from the overhang area 20. The distance between the lower end 28 and upper end 30 of the barrier 14 defines the barrier height BH of the barrier 14, as shown in FIGS. 1-3. The inward side 32 of barrier 14 faces inwardly toward the passageway 18 and the outward side 34 of barrier 14 faces outwardly toward the overhang area 20, as shown in FIGS. 2 and 3. The distance between the inward side 32 and the outward side 34 defines the barrier width BW of the barrier 14, as shown in FIG. 3. The ledge 12 is either defined by the upper surface 36 of the barrier 14 or its located on the outward side 34 of the barrier, as best shown in FIGS. 1-3. As well known in the relevant art, in one configuration the barrier body 26 of the barrier 14 is sized and configured to stop a motor vehicle that is on the passageway 18 from leaving the passageway surface 38 and entering the overhang area 20, which could result in the motor vehicle crashing down onto the lower surface 22 below the bridge 24 (or other elevated structure) and severely injuring or killing the occupants of the motor vehicle.

In one very common configuration for passageway barriers used with bridges 24 over a roadway or other lower surface 22, the barrier 14 has a railing 16 that extends upward from the upper surface 36 of the barrier 14, as best shown in FIGS. 1-2, to provide increased impediment for persons or vehicles moving on the passageway surface 38 from crossing over into the overhang area 20 and falling to the lower surface 22 from the bridge 24. In these configurations, the railing 16 has a railing body 40, a lower end 42 at or near the upper end 30 of the barrier 14, an upper end 44 is spaced apart relation above the lower end 42 thereof, an inward side 46 and an outward side 48, as shown in FIGS. 1-2. The distance between the lower end 42 and upper end 44 of the railing 16 defines the railing height RH and the distance between the inward side 46 and outward side 48 defines the railing width RW, as shown in FIGS. 1-2. The inward side 46 of railing 16 faces inwardly toward the passageway 18 and the outward side 48 of railing 16 faces outwardly toward the overhang area 20, as shown in FIG. 2. In one common configuration, the railing 16 comprises a chain link fence, plurality of spaced apart rods or the like having a railing body 40 with a plurality of railing openings 50 and one or more, typically a plurality of, support posts 52 that support the railing 16 along the barrier 14, as best shown in FIGS. 1 and 13.

The new apparatus 10 of the present invention is sized and configured in cooperative arrangement with the barrier 14, with or without the railing 16, such that when the circumstances require limiting the transverse movement of a person on the ledge 12, usually a potential jumper, one part of the apparatus 10 will be held at or near the inward side 32 of the barrier 14 and, if applicable, the inward side 46 of the railing 16, and another part of the apparatus 10 will extend into the overhang area 20, through the railing 16 (as applicable) and across the ledge 12 to prevent transverse movement by the person past the boundary that is defined by the location of the apparatus 10. In normal usage, a pair of apparatuses 10 will be utilized to define a range of transverse movement, typically relatively narrow, that the person on the ledge 12 will be able to move between the spaced apart pair of apparatuses 10. In one typical use, the two apparatuses 10 will be spaced apart a distance that is less than the width of a large inflatable bag that is placed on the lower surface 22 below the ledge 12 so the person will land on the bag if he or she does jump from the ledge 12.

An embodiment of the apparatus 10 of the present invention for use with barriers 14 that have a railing 16 is shown in FIGS. 5-8. As shown in these figures, the apparatus 10 comprises an upright member 54, a generally horizontal base member 56 that is attached to or integral with the upright member 54, a barrier engaging mechanism 58 associated with the upright member 54 to engage the barrier body 26 of the barrier 14 and a plurality of outwardly extending limiting members 60 that are attached to or integral with the upright member 54 and sized and configured to extend from the upright member 54 into the overhang area 20 and across the ledge 12 to prevent transverse movement past the apparatus 10. As set forth in more detail below, the apparatus 10 is structured and arranged such that when the apparatus 10 is in use the base member 56 thereof is positioned at or against the passageway surface 38 and the upright member 54 is position at or against the barrier 14 so as to extend the limiting members 60 into the overhang area 20 and across the ledge 12. Typically, the apparatus 10 will also have one or more handles 61 attached to or integral with the upright member 54, such as a pair of U-shaped handles 61*a* and 61*b* and a straight handle 61, as shown in FIGS. 5 and 7-9. The handles 61 can be utilized by the users of the apparatus 10 to move the apparatus 10 in place, position the apparatus 10 and, as may be necessary, to hold the apparatus 10 in position.

The upright member 54, which has a lower end 62 and an upper end 64 in spaced apart relation to the lower end 62, is sized and configured such that the lower end 62 will be generally at or against the passageway surface 38 and the upper end 63 will be at or above the upper end 30 of the barrier 14 when the apparatus 10 is in use to limit transverse movement along the ledge 12, as shown in FIGS. 5-11. The base member 56 has a first or proximal end 66 that is attached to or integral with the upright member 54 (typically at the lower end 62 thereof) and a second or distal end 68 that is in spaced apart relation to the first/proximal end 66 so as to extend rearwardly from the upright member 54 to support the apparatus 10 as it stands at or adjacent to the barrier 14, as shown in FIGS. 5-11. The barrier engaging mechanism 58 is attached to or integral with the upright member 54 and extends forwardly therefrom to removably engage the barrier 14 to help hold the apparatus 10 at or against the barrier 14, as shown in FIGS. 8 and 11, when the apparatus 10 is in use to limit transverse movement along the ledge 12 to reduce the likelihood that the apparatus 10 will become separated from the barrier 14 and to reduce the amount of effort that is required by the user of the apparatus 10 to hold the apparatus 10 in the desired or necessary position. Each of the limiting members 60 have a first or proximal end 70 that is attached to or integral with the upright member 54 and a second or distal end 72 that extends forwardly from the upright member 54 toward and into the overhang area 20 such that each limiting member 60 crosses the ledge 12 to prevent a person on the ledge 12 from moving past the apparatus 10 so as to limit his or her movement on the ledge 12 to the space between a pair of apparatuses 10, which is referred to herein as the allowed movement area 116, as shown in FIG. 13.

Figure 12:
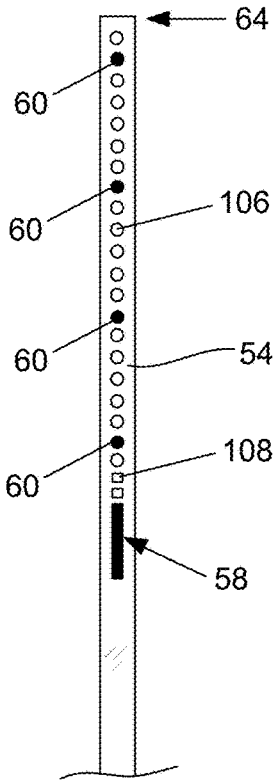
FIG. 12 is a front view of an alternative configuration for the upright member of the apparatus of FIG. 5 showing use of apertures for the limiting members and apertures for the barrier engaging mechanism.

For purposes of describing the use and relative location of the various components of the present invention, the terms "upper", "upward", "upwardly", "upper" and "top" and the like and the terms "lower", "downward", "downwardly" and "bottom" and the like refer to the direction, respectively, shown for the upper end 62 and the lower end 64 of the upright member 54 when the apparatus 10 is held in its normal upright "in use" position at the barrier 14 with the lower end 64 of upright member 54 at or against the passageway surface 38, as shown in FIGS. 8 and 11. Likewise, the terms "front", "forward", "forwardly" and the like and the terms "back", "rearward", "rearwardly" and the like are utilized to refer to the direction of various components of the apparatus 10 with regard to the overhang area 20, which is in the forward direction, and the passageway 18, which is in the rearward direction, when the apparatus 10 is in use at or adjacent the barrier 14, as shown in FIGS. 8, 11 and 12. For instance, the inward side 32 of the barrier 14 and the inward side 46 of the railing 16 face in a rearward direction and the outward side 34 of the barrier 14 and the outward side 48 of the railing 16 face in forward direction. In addition, in the embodiments of the apparatus 10 shown in FIGS. 5-9, the handles 61 extend in a rearward direction.

Figure 4:
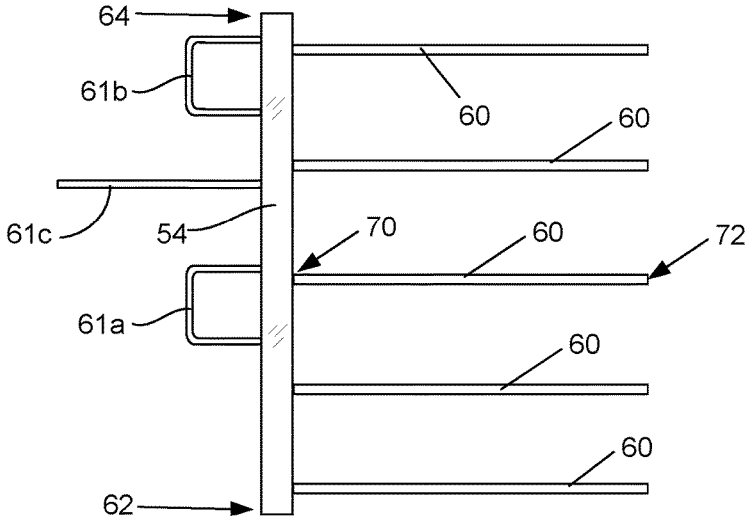
FIG. 4 (PRIOR ART)
FIG. 4 is a side view of a prior art apparatus that is utilized to limit the movement of a person on an overhanging ledge that is configured for use with a barrier/railing combination such as shown in FIGS. 1 and 2.

As set forth in the Background and shown in FIG. 4, a prior art apparatus, shown as 74, for limiting the transverse movement of a person on a ledge 12 of barrier 14 at the edge of a passageway 18 across a bridge 24 over a freeway or other lower surface 22 also comprises an upright member 54 having a plurality of outwardly extending limiting members 60 attached to or integral with the upright member 54. As shown in FIG. 4, the limiting members 60 of the prior art apparatus 74 are position along the upright member 54 between the lower end 62 and upper end 64 thereof. In use, a person has to stand next to the barrier 14 and railing 16 and hold the prior art apparatus 74 in position, typically with the limiting members 60 through the railing openings 50 in the railing 16. As will be readily appreciated by persons who use the prior art apparatus 74, it can become quite tiresome to stand and hold the prior art apparatus 74 in place during the entire time it takes to negotiate with the person on the ledge 12 to persuade him or her to not jump and move back to a safe area (i.e., on the passageway surface 38). As a result of being tired, it can become possible for the person on the ledge 12 to move past the prior art apparatus 74, thereby defeating the limiting purpose of using the prior art apparatus 74. As will be readily apparent to persons skilled in the relevant art, the new apparatus 10 of the present invention solves the problems with the prior art apparatus 74 and, therefore, is more effective at limiting the transverse movement of a person on the ledge 12 of a barrier 14. The prior art apparatus 74 also has handles 61, such as the U-shaped handles 61*a* and 61*b* and the straight handle 61*c*, attached to or integral with the upright member 54.

The upright member 54 of the apparatus 10 of the present invention can be a solid rod or it can be tubular, which is likely to result in less cost and weight for the apparatus 10. The upright member 54 can be made out of a metal, plastic, composite or other material that provides an upright member 54 which is sufficiently strong and stiff enough to be utilized to prevent persons from moving on the ledge 12 past the location of the apparatus 10. In the embodiments of FIGS. 5-8, the upright member 54 is a single sized member that is of sufficient length to position the limiting members 60 above the barrier 14 so they can extend through the railing openings 50 in the railing 16, as shown in FIG. 8. In the embodiment of FIG. 9, the upright member 54 has a height adjusting mechanism 76 operatively associated therewith that is configured to allow the upright member 54 to be adjustable in height (i.e., the length of the upright member 54) so the of the apparatus 10 user can raise or lower the upright member 54 as needed so he or she can position the limiting members 60 of the apparatus 10 where they can be best utilized to limit the transverse movement of a person on a ledge 12 associated with a barrier 14. In the embodiment shown in FIG. 9, the upright member 54 of the apparatus 10 is telescopically configured with a first upright member 54*a* in telescopic relation with a second upright member 54*b* and a positioning member 78, such as a pin or the like, interconnecting the two upright members 54*a*/54*b* to fix the height of the upright member 54 and, therefore, the vertical position of the limiting members 60. As set forth above, in one embodiment, the limiting members 60 are positioned so they will extend through the railing openings 50 into the overhang area 20 and across the ledge 12 to prevent movement on the ledge 12 past the location of the apparatus 10. As will be readily appreciated by persons who are skilled in the relevant art, a wide variety of different types of telescopic configurations can be utilized for the upright member 54 to allow it to be adjustable in height.

As with the upright member 54, the base member 56 of the apparatus 10 of the present invention can be a solid rod or it can be tubular, which is likely to result in less cost and weight for the apparatus 10. The base member 56 can be made out of a metal, plastic, composite or other material that provides an base member 56 which is sufficiently strong and stiff enough to be utilized to help hold the upright member 54, to which the base member 56 is attached or integrally formed, in place so that the limiting members 60 will prevent persons from moving on the ledge 12 past the location of the apparatus 10. In the embodiments of FIGS. 5-8, the base member 56 is a single sized member that is of sufficient length to allow a person to stand on the base member 56 or to place weighted objects, such as sandbags or the like, on the base member 56 to hold the upright member 54 in position so the limiting members 60 can extend through the railing openings 50 in the railing 16, as shown in FIG. 8. In the embodiment of FIG. 9, the base member 56 has a length adjusting mechanism 80 operatively associated therewith that is configured to allow the base member 56 to be adjustable in length so the user of the apparatus 10 can shorten or extend the base member 56 as needed to take into account different configurations of the barrier 14 that may result in more or less set-back, relative to the railing 16, so the limiting members 60 of the apparatus 10 will be in position where they can limit the transverse movement of a person on a ledge 12 associated with a barrier 14. In the embodiment shown in FIG. 9, the base member 56 of the apparatus 10 is telescopically configured with a first base member 56*a* in telescopic relation with a second base member 56*b* and a positioning member 82, such as a pin or the like, interconnecting the two members 54*a*/54*b* so as to fix the length of the base member 56 and, as set forth above, to position the limiting members 60 so they will extend through the railing openings 50 into the overhang area 20 and across the ledge 12 to prevent movement on the ledge 12 past the location of the apparatus 10. As will be readily appreciated by persons who are skilled in the relevant art, a wide variety of different types of telescopic configurations can be utilized with the base member 56 to allow it to be adjustable in length.

To assist the user with being able to hold the base member 56 in place so as to easily and securely position the upright member 54 and the various limiting members 60 to effectively limit the movement of a person on a ledge 12 from moving past the apparatus 10, a preferred embodiment of the new apparatus 10 comprises a footplate 84 attached to or integral with the base member 56, as shown in FIGS. 5-12 and 13. In one configuration, the footplate 84 is attached or integral with the lower surface 86 of the base member 56 and extends outwardly from the base member 56 to provide additional space for the user to weigh the base member 56 down (either by standing on the footplate 84 or placing weighted objects on the footplate 84) to reduce the likelihood the apparatus 10 can be dislodged from its limiting position, shown as 88 in FIGS. 8, 9 and 13, during use thereof to limit the movement of a person on the ledge 12.

The footplate 84 can be a generally planar plate member 90, as best shown in FIGS. 5-6, 8 and 11. In the embodiments shown in FIGS. 5-13, the footplate 84 extends outward from one side of the base member 56 to provide an upwardly disposed plate surface 92. As will be readily appreciated by persons skilled in the art, however, the footplate 84 can extend outward from one or both sides and/or the end of the base member 56 to provide one or more upwardly disposed plate surfaces 92. In one embodiment, the footplate 84 is made out of the same material as base member 56.

In a preferred embodiment of the new movement limiting apparatus 10 of the present invention, the apparatus 10 has a barrier engaging mechanism 58 that is attached to or integral with either the upright member 54 or base member 56. The barrier engaging mechanism 58 is structured and arranged to engage the barrier 14 and assist with holding the apparatus 10 in place at or near the barrier 14 when the apparatus 10 is in use to limit the movement of a person on the ledge 12 associated with the barrier 14, as best shown in FIGS. 5, 8, 11 and 13. In the preferred embodiments, the barrier engaging mechanism 58 is configured to at least substantially hold the apparatus 10 at or against the barrier 14 in a manner which generally reduces the likelihood the person on the ledge 12 will be able to push the apparatus 10 away from the barrier 14 and, therefore, pass by the limiting position 88 that was intended to be defined by placement of the apparatus 10 at the barrier 14. In addition, the barrier engaging mechanism 58 is configured to further reduce the need for a police officer, firefighter or other rescuer from having to continuously apply force to the apparatus 10 to hold the limiting members 60 in position across the ledge 12 and into the overhang area 20, which is necessary to prevent the transverse movement of a person on the ledge 12 past the apparatus 10 (i.e., the limiting position 88).

Figure 5:
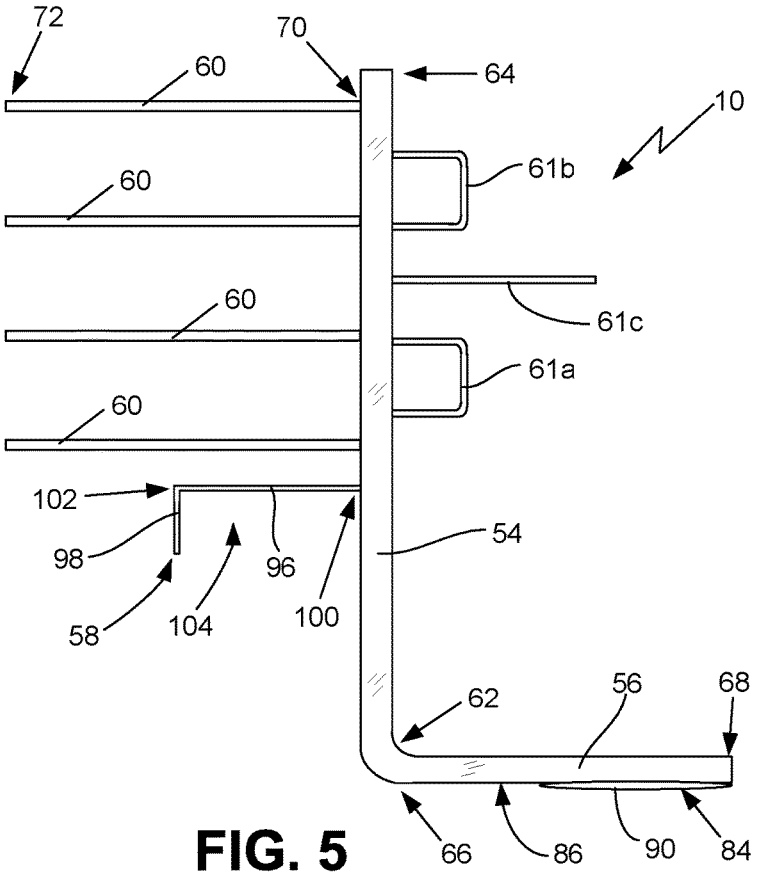
FIG. 5 is a side view of a movement limiting apparatus that is configured according to a first embodiment of the present invention for limiting transverse movement along an overhanging ledge of the barrier/railing combination shown in FIGS. 1 and 2.
Figure 6:
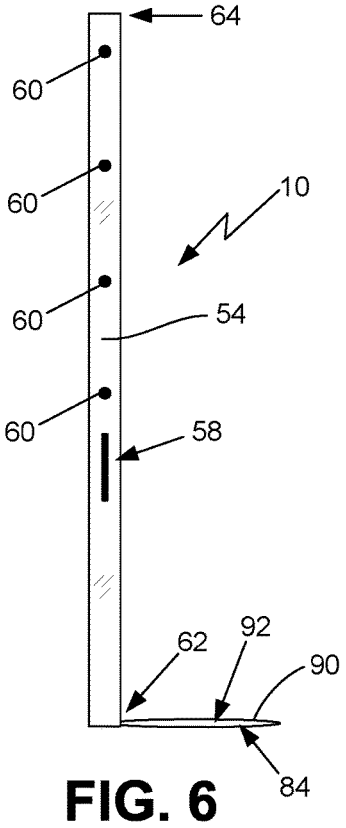
FIG. 6 is a front view of the apparatus of FIG. 5.
Figure 7:
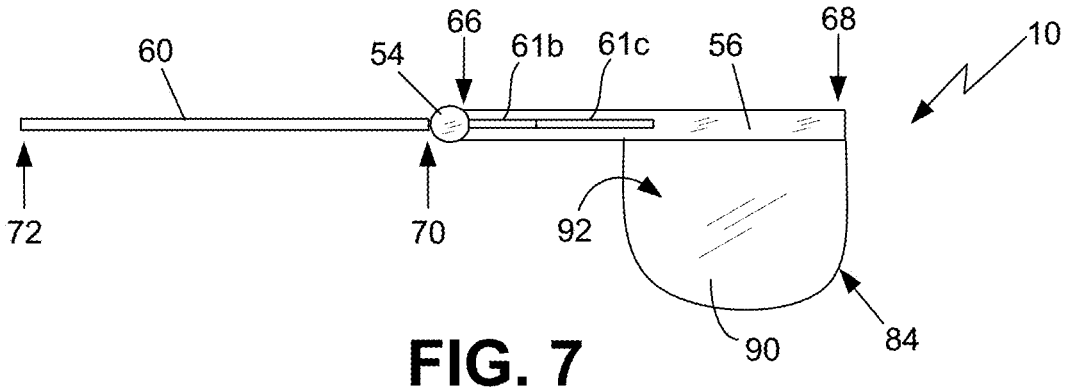
FIG. 7 is a top view of the apparatus of FIG. 5.

In the embodiment of the apparatus 10 shown in FIGS. 5-9, the barrier engaging mechanism 58 comprises an L-shaped engaging member 94 having a horizontally disposed first member 96 and a vertically disposed second member 98, with the first or proximal end 100 of the first member attached to or integral with the upright member 54 and the second member 98 extending downward from the second or distal end 102 of the first member 96, as best shown in FIGS. 5 and 9. In one configuration, the distance between vertically disposed second member 98 and the upright member 54, which is referred to as the barrier gap 104, is sized and configured to be slightly larger than the barrier width BW of the barrier 14 so that the apparatus 10 will be tightly held against the barrier 14, as shown in FIG. 8. In use, the apparatus 10 is placed at the barrier 14 with the lowermost end of the vertical second member 98 of the L-shaped engaging member 94 above the upper end 30 of the barrier 14 and then lowered so the barrier 14 is received into the barrier gap 104, which will position the upright member 54 at or adjacent the inward side 32 of the barrier 14 and the second member 98 at the outward side 34 of the barrier 14, as shown in FIG. 8. As will be readily appreciated by persons skilled in the art, this will make harder for a potential jumper to push the apparatus 10 away from the barrier 14 and make it easier for the rescuer to ensure that the apparatus 10 stays in place to define a limiting position 88. In some embodiments of the barrier engaging mechanism 58, the horizontal first member 96 of the L-shaped engaging member 94 can be adjustable in length, such as being telescopically configured, to allow the user to adjust the barrier gap 104 for barriers 14 having different barrier widths BW. The L-shaped engaging member 94 should be made out materials that are sufficiently strong and stiff enough to achieve the objective of holding the apparatus 10 in place at the barrier 14.

As set forth above, the limiting members 60 of the apparatus 10 are the objects that are utilized to create an impediment to a person on the ledge 12 from being able to move transversely along the ledge 12 past the limiting position 88 defined by the location of the apparatus 10. In a preferred embodiment, each of the limiting members 60 are made out of strong and stiff material, such as metal, composites, some plastics and the like, so the limiting members 60 will extend outward from the first/proximal end 70 to their second/distal end 72 to provide a fence-like impediment to a person who is on the ledge 12 associated with a barrier 14. If desired, a brace or other stiffening member can be associated with each of the limiting members 60 to ensure that they extend substantially inflexibly out to the overhang area 20 and across the ledge 12. Although the limiting members 60 are shown as extending horizontally (i.e., in a perpendicular relation) from the upright member 54 in FIGS. 5-9, persons who are skilled in the art will readily appreciate that the extending horizontal is not required, as the limiting members 60 may be at various angles, upward or downward, relative to the upright member 54. In any configuration, the limiting members 60 should be sized and configured so they can fit through the railing openings 50 in the railing body 40 of the railing 16 and be of sufficient length to extend beyond the ledge 12 into the overhang area 20 to provide the necessary impediment to transverse movement past the limiting position 88 defined by the location of the apparatus 10 by a person who is on the ledge 12. In one configuration, the limiting members 60 can be adjustable in length to accommodate different configurations of the barrier 14 and/or the railing 16 in relation to the location of the ledge 14 and passageway surface 38 where the base member 56 will typically be placed.

In one configuration of the new apparatus 10 of the present invention, the limiting members 60 and the L-shaped engaging member 94 have specific locations where they are either integrally formed with or attached to the upright member. In an alternative embodiment, the upright member 54 has a plurality of apertures 106 that are sized and configured to removably receive the limiting members 60 and a plurality of apertures 108 that are sized and configured to removably receive the first member 96 of the L-shaped engaging member 94, as shown in FIG. 12. In one configuration, the apertures 106 for the limiting members 60 are different sizes and/or different shapes than the apertures 108 for the first member 96 of the L-shaped engaging member 94 to ensure that the placement of these components are not mixed up. In other configurations, the apertures 106 and apertures 108 can be the same size and shape. By providing a plurality of the apertures 106 and apertures 108 in the upright member 54, as shown in FIG. 12, will allow the user to select the number and placement of the limiting members 60 and the barrier engaging mechanism 58 so that they can be "customized" for a particular barrier 14 and railing 16 arrangement. In addition, the user would be able to select limiting members 60 that are sized to fit through the railing openings 50 of the railing body 40 for different configurations of railings 16 (specifically for different sizes and shapes of the railing openings 50) and a different type or size of barrier engaging mechanism 58 for the size and shape of the barrier 14.

An embodiment of the apparatus 10 of the present invention for use with barriers 14 not having a railing 16 is shown in FIGS. 10-11. For this type of barrier 14, the apparatus 10 is sized and configured to extend over the upper end 30 of the barrier 14, across the upper surface 36 and down the outward side 34 of the barrier 14, as shown in FIG. 11. To achieve this objective, the apparatus 10 has a crossing member 110 that is positioned across or above the upper surface 36 and a downward extending outward member 112 that extends downward from the crossing member 110 to or at least toward the ledge 12 associated with the barrier 14 to form the apparatus 10 into an inverted U-shaped configuration. The spacing between the outward member 112 and the upright member 54 defines the barrier gap 104 in which the barrier 14 is received, as shown in FIG. 11, to provide barring engaging mechanism 58 that helps hold the apparatus 10 in place at the barrier 14. Specifically, in this embodiment, the barrier engaging mechanism 58 comprises the upright member 54, crossing member 110 and outward member 112 being cooperatively sized and configured to form the inverted U-shape in which the barrier 14 is received to help secure the apparatus 10 to the barrier 14. As shown in FIGS. 10-11, each of the limiting members 60 are attached to or integral with the outward member 112 and are positioned to extend outwardly from the outward member 112 across the ledge 12 and into the overhang area 20. For this type of configuration, the U-shaped handle 61*a* is attached to the upright member 54 and the other U-shaped handle 61*b* is attached to or integral with the crossing member 110, as shown in FIGS. 10-11.

In one configuration, the crossing member 110 is fixedly attached to or integral with the upright member 54 and the outward member 112 is fixedly attached to or integral with the crossing member 110 for a specific size and shape of barrier 14. In other configurations, the apparatus 10 is adjustable for different sizes and shapes of barrier 14. In FIG. 12, the apparatus 10 utilizes the height adjusting mechanism 76 described above for the upright member 54. For this use, the crossing member 110 is telescopically arranged with the upright member 54 to allow the user to raise or lower the crossing member 110 and outward member 112 relative to the upright member 54 and then secure the positioning of these components with a positioning member 78, such as a pin or the like. If desired, the combination of the upright member 54 and base member 56 can be sized and configure to be selectively utilized with as either the embodiment shown in FIGS. 5-9 or the embodiment shown in FIGS. 10-11 depending on what component (i.e., the upper half of the upright member 54 or the crossing member 110) is attached to the lower half of the upright member 54 or the full upright member 54.

FIG. 13 shows a movement limiting system 114 that utilizes a pair of the above-described apparatuses 10, shown as first apparatus 10*a* and second apparatus 10*b*, in spaced apart relation to each other to define, respectively, a first limiting position 88*a* and a second limiting position 88*b*, when utilized with a barrier 14 (with or without a railing 16) having a ledge associated therewith. Collectively, the first limiting position 88*a* and the second limiting position 88*b* define an allowed movement area 116 where a person on the ledge 12 will be allowed to move. As set forth above, the allowed movement area 116 should be less than the width of an inflated bag that will be placed on the lower surface 22 below the ledge 12 so if the person on the ledge 12 jumps off the bridge 24, or other elevated structure, he or she is going to be likely to land on the inflated bag to reduce the likelihood of serious injury or death from the jump. The embodiment shown in FIG. 13 is shown in use with a barrier 14 having a railing 16 with the limiting members 60 extending outward across the ledge 12 and into the overhang area 20 to limit movement on the ledge 12 to only that distance, the allowed movement area 116, between the limiting members 60 of the first apparatus 10*a* and the limiting members 60 of the second apparatus 10*b*. The system 114 for the embodiment of FIGS. 10-11 will similarly define an allowed movement area 116 between a pair of apparatuses 10.

The apparatus 10 of the present invention will have components that are sized and configured to be in cooperative relation with the barrier 14 and the railing 16 and for the ledge 12 associated with the barrier 14. In use, the apparatus 10 is positioned at or adjacent a barrier 14, with or without a railing 16, with the base member 56 typically on the passageway surface 38 and the upright member 54 near the inward side 32 of the barrier 14, as shown in FIGS. 8,11 and 13. For use with a barrier 14 having a railing 16, the limiting members 60 are placed through the railing openings 50 so they extend across the ledge 12 and into the overhang area 20 and the L-shaped engaging member 94 of the barrier engaging mechanism 58 is placed in engagement with the barrier 14 (i.e., as described above). If applicable and necessary, the user will adjust the size, type and position of the various components of the apparatus 10 so the apparatus 10 is securely placed at the desired limiting position 88. For use with a barrier 14 without a railing 16, the user will form, if not already formed, the apparatus 10 into the inverted U-shaped configuration with the crossing member 110 and the outward member 112 so the limiting members 60 extend outward from the outward member 112 across the ledge 12 and into the overhang area 20. With a pair of apparatuses 10*a*/10*b* in place, as shown in FIG. 13, the apparatuses 10*a*/10*b* will define the allowed movement area 116 that limits the amount a person on the ledge 12 can move so the rescuers can better be able to take action to talk him or her off the ledge 12 or limit the likelihood of injury or death if the person does decide to jump off the ledge 12 of an elevated surface.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there may be numerous components of the embodiments described herein that can be readily replaced with equivalent functioning components to accomplish the objectives and obtain the desired aspects of the present invention. The various embodiments set forth herein are intended to explain the best mode of making and using the present invention as currently known to and appreciated by the present inventor(s) and to enable other persons who are skilled in the relevant art to make and utilize the present invention. Although, the described embodiments may comprise different features, not all of these features are required in all embodiments of the present invention. More specifically, as will be readily appreciated by persons who are skilled in the art, certain embodiments of the present invention only utilize some of the features and/or combinations of features disclosed herein.

What is claimed is:

1. A movement limiting apparatus for use with a barrier separating a passageway having a passageway surface located on an inward side of the barrier and an overhang area on an outward side of the barrier, with the barrier having a ledge located in or toward the overhang area so as to extend outward from the barrier in spaced apart relation above a lower surface which extends under the passageway such that the passageway surface allows passage over the lower surface, said apparatus comprising:

an upright member having a lower end and an upper end, said upright member sized and configured to be position at the inward side of the barrier when said apparatus is utilized with the barrier to prevent movement along the ledge associated with the barrier;

a base member attached to or integral with said lower end of said upright member, said base member configured to be positioned at the passageway surface of the passageway when said apparatus is utilized with the barrier; and a plurality of outwardly extending limiting members, each of said limiting members connected to said upright member so as to be supported thereby and to extend across the ledge and into the overhang area so as to prevent movement on the ledge past said apparatus when said upright member is at the inward side of the barrier.

2. The apparatus of claim 1, wherein an upper end of the barrier defines an upper surface thereof, the barrier has a railing above the upper surface of the barrier, the ledge is defined by the upper surface of the barrier between the railing and an outward side of the barrier and each one of said limiting members are sized and configured to extend through a railing opening in the railing so as to define a limiting position with said apparatus.

3. The apparatus of claim 2, wherein said upper end of said upright member extends above an upper end of the railing and each of said limiting members are disposed between a lower end and the upper end of the railing.

4. The apparatus of claim 1 further comprising a footplate attached to or integral with said base member, said footplate having a plate surface on which weight may be placed to secure said base member to the passageway surface and said upright member at the inward side of the barrier.

5. The apparatus of claim 1 further comprising a barrier engaging means attached to or integral with at least one of said upright member and said base member, said barrier engaging means being structured and arranged to engage the barrier to securely position said upright member at the inward side of the barrier when said apparatus is utilized with the barrier.

6. The apparatus of claim 5, wherein said barrier engaging means comprises an L-shaped engaging member having a horizontally disposed first member that is attached to or integral with said upright member and a downwardly disposed second member that is attached to or integral with said first member to define a barrier gap between said second member and said upright member that is sized and configured to receive the barrier therein when said apparatus is utilized to define a limiting position to prevent movement on the ledge past said apparatus.

7. The apparatus of claim 5, wherein said barrier engaging means comprises a crossing member attached to or integral with said upright member so as to extend across an upper end of the barrier and an outward member extending downward from said crossing member in spaced apart relation to said upright member so as to define a barrier gap therebetween that is sized and configured to receive the barrier therein when said apparatus is utilized to define a limiting position to prevent movement on the ledge past said apparatus.

8. The apparatus of claim 7, wherein each of said limiting members are attached to or integral with said outward member so as to extend outwardly therefrom across the ledge and into the overhang area.

9. A movement limiting apparatus for use with a barrier separating a passageway having a passageway surface located on an inward side of the barrier and an overhang area on an outward side of the barrier, with the barrier having a ledge located in or toward the overhang area so as to extend outward from the barrier in spaced apart relation above a lower surface which extends under the passageway such that the passageway surface allows passage over the lower surface, said apparatus comprising:

an upright member having a lower end and an upper end, said upright member sized and configured to be position at the inward side of the barrier when said apparatus is utilized with the barrier to prevent movement along the ledge associated with the barrier;

a base member attached to or integral with said lower end of said upright member, said base member configured to be positioned at the passageway surface of the passageway when said apparatus is utilized with the barrier;

a barrier engaging means attached to or integral with at least one of said upright member and said base member, said barrier engaging means being structured and arranged to engage the barrier to securely position said upright member at the inward side of the barrier when said apparatus is utilized with the barrier; and a plurality of outwardly extending limiting members, each of said limiting members having a proximal end attached connected to said upright member so as to extend a distal end of said limiting members into the overhang area and position each of said limiting members across the ledge so as to prevent movement on the ledge past said apparatus when said upright member is at the inward side of the barrier and said base member is at the passageway surface.

10. The apparatus of claim 9, wherein an upper end of the barrier defines an upper surface thereof, the barrier has a railing above the upper surface of the barrier, the ledge is defined by the upper surface of the barrier between the railing and an outward side of the barrier and each one of said limiting members are sized and configured to extend through a railing opening in the railing so as to define a limiting position with said apparatus.

11. The apparatus of claim 10, wherein said upper end of said upright member extends above an upper end of the railing and each of said limiting members are disposed between a lower end and the upper end of the railing.

12. The apparatus of claim 9 further comprising a footplate attached to or integral with said base member, said footplate having a plate surface on which weight may be placed to secure said base member to the passageway surface and said upright member at the inward side of the barrier.

13. The apparatus of claim 9, wherein said barrier engaging means comprises an L-shaped engaging member having a horizontally disposed first member that is attached to or integral with said upright member and a downwardly disposed second member that is attached to or integral with said first member to define a barrier gap between said second member and said upright member that is sized and configured to receive the barrier therein when said apparatus is utilized to define a limiting position to prevent movement on the ledge past said apparatus.

14. The apparatus of claim 9, wherein said barrier engaging means comprises a crossing member attached to or integral with said upright member so as to extend across an upper end of the barrier and an outward member extending downward from said crossing member in spaced apart relation to said upright member so as to define a barrier gap therebetween that is sized and configured to receive the barrier therein when said apparatus is utilized to define a limiting position to prevent movement on the ledge past said apparatus.

15. The apparatus of claim 14, wherein each of said limiting members are attached to or integral with said outward member so as to extend outwardly therefrom across the ledge and into the overhang area.

16. A movement limiting system, comprising:

a passageway having a passageway surface;

an overhang area located above a lower surface which extends under said passageway such that said passageway surface allows passage over said lower surface;

a barrier separating said passageway and said overhang area, with said passageway surface located on an inward side of said barrier and said overhang area located on an outward side of said barrier;

a ledge associated with said barrier, said ledge located in or toward said overhang area so as to extend outward from said barrier in spaced apart relation above said lower surface;

a first movement limiting apparatus; and a second movement limiting apparatus in spaced apart relation to said first movement limiting apparatus so as to define an allowed movement area therebetween, wherein each of said first movement limiting apparatus and said second movement limiting apparatus have an upright member with a lower end and an upper end, a base member attached to or integral with said lower end of said upright member and a plurality of outwardly extending limiting members that are connected to said upright member, said upright members configured to be position at an inward side of said barrier, said base member configured to be positioned at said passageway surface of said passageway, each of said limiting members sized and configured to extend across said ledge and into said overhang area so as to prevent movement on said ledge outside of said allowed movement area when said first apparatus and said second apparatus are utilized with said barrier to limit movement along said ledge.

17. The system of claim 16, wherein each of said first apparatus and said second apparatus further comprise a barrier engaging means attached to or integral with at least one of said upright member and said base member, said barrier engaging means being structured and arranged to engage said barrier to securely position said upright member at said inward side of said barrier.

18. The system of claim 17, wherein said barrier engaging means comprises an L-shaped engaging member having a horizontally disposed first member that is attached to or integral with said upright member and a downwardly disposed second member that is attached to or integral with said first member to define a barrier gap between said second member and said upright member that is sized and configured to receive said barrier therein when said first apparatus and said second apparatus are utilized to prevent movement on said ledge outside of said allowed movement area.

19. The system of claim 17, wherein said barrier engaging means comprises a crossing member attached to or integral with said upright member so as to extend across an upper end of said barrier and an outward member extending downward from said crossing member in spaced apart relation to said upright member so as to define a barrier gap therebetween that is sized and configured to receive said barrier therein when said first apparatus and said second apparatus are utilized to prevent movement on said ledge outside of said allowed movement area, each of said limiting members attached to or integral with said outward member so as to extend outwardly therefrom across said ledge and into said overhang area.

20. The system of claim 16, wherein each of said first apparatus and said second apparatus have a footplate that is attached to or integral with said base member, said footplate having a plate surface on which weight may be placed to secure said base member to said passageway surface and said upright member at said inward side of said barrier.

* * * * *